US006814314B1

(12) United States Patent
Ruehle et al.

(10) Patent No.: US 6,814,314 B1
(45) Date of Patent: Nov. 9, 2004

(54) FUEL INJECTION VALVE

(75) Inventors: Wolfgang Ruehle, Ditzingen (DE); Hubert Stier, Asperg (DE); Matthias Boee, Ludwigsburg (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 307 days.

(21) Appl. No.: 09/857,335

(22) PCT Filed: Sep. 29, 2000

(86) PCT No.: PCT/DE00/03452

§ 371 (c)(1),
(2), (4) Date: Sep. 6, 2001

(87) PCT Pub. No.: WO01/25613

PCT Pub. Date: Apr. 12, 2001

(30) Foreign Application Priority Data

Oct. 2, 1999 (DE) ..... 199 47 779

(51) Int. Cl.[7] ..... F02M 51/00

(52) U.S. Cl. ..... 239/585.5; 239/533.3; 239/533.9

(58) Field of Search ..... 239/585.5, 585.1–585.4, 239/533.3, 533.9, 533.11; 251/129.19, 129.21

(56) References Cited

U.S. PATENT DOCUMENTS 4,437,644 A * 3/1984 Wilmers ..... 251/11
4,766,405 A * 8/1988 Daly et al. ..... 335/257
5,088,467 A * 2/1992 Mesenich ..... 123/531
5,236,173 A * 8/1993 Wakeman ..... 251/129.16
6,085,990 A * 7/2000 Augustin ..... 239/88
6,148,842 A * 11/2000 Kappel et al. ..... 137/79
6,382,189 B1 * 5/2002 Hlousek ..... 123/506
6,382,532 B1 * 5/2002 French et al. ..... 239/585.1
6,494,389 B1 * 12/2002 Reiter ..... 239/585.1
6,520,434 B1 * 2/2003 Reiter ..... 239/585.5

FOREIGN PATENT DOCUMENTS

| | | |
|---|---|---|
| DE | 197 02 066 | 7/1998 |
| DE | 197 27 992 | 1/1999 |
| EP | 0 921 301 | 6/1999 |

* cited by examiner

*Primary Examiner*—Michael Mar
*Assistant Examiner*—Thach H. Bui
(74) *Attorney, Agent, or Firm*—Kenyon & Kenyon

(57) ABSTRACT

A fuel injection valve, in particular an injection valve for fuel injection systems of internal combustion engines, is made of a piezoelectric or magnetostrictive actuator and a valve closing body that can be set in motion by the actuator via a valve needle and that interacts with a valve seat surface to produce a seat. To compensate for the temperature expansion, at least one damping element made of a solid is present and exhibits an almost static behavior at a high deformation rate and is elastically or plastically deformable at a low deformation rate.

16 Claims, 1 Drawing Sheet

FUEL INJECTION VALVE

FIELD OF THE INVENTION

The present invention relates to a fuel injection valve.

BACKGROUND INFORMATION

Usually changes in the length of a piezoelectric actuator of a fuel injection valve caused by temperature influences are compensated for via hydraulic devices or by selecting suitable combinations of materials.

A fuel injection valve in which the change in length of the actuator is compensated for by an appropriate combination of materials is known from German Patent No. 197 02 066. The fuel injection valve arising from this publication has an actuator that is conducted in the valve housing under spring prestress and that interacts with an actuating part made of an actuating body and a head part, the head part lying on the piezoelectric actuator and the actuating body penetrating an inner recess of the actuator. The actuating body is operably connected to a valve needle. When the actuator is set in motion, the valve needle is actuated against the direction of spraying.

The actuator and the actuating body have at least approximately the same length and are made of a ceramic material or of a material similar to ceramic with respect to its thermal expansion. The result of using materials having the same lengths and thermal expansion coefficients, e.g., INVAR, is that the actuator and the actuating body expand uniformly under the influence of heat and thus do not have an adverse effect on the opening and closing times. An undesired opening of the fuel injection valve between the switching pulses is also avoided.

The disadvantage of this arrangement is above all its limited usability in systems that are subject to large fluctuations in temperature. The arrangement known from German Patent No. 197 02 066 does not achieve the objective due to the nonlinear behavior of the temperature expansion coefficients of piezoelectric ceramics over the temperature curve. As a result, imprecise fuel metering times and amounts occur.

Another disadvantage is the high manufacturing effort required, which is associated with relatively high costs caused in particular by the selection of the materials (e.g., INVAR).

SUMMARY OF THE INVENTION

The fuel injection valve of the present invention with the characterizing features of the main claim, on the other hand, has the advantage that the temperature compensation is independent of the thermal expansion coefficient of the piezoelectric ceramic. The thermal expansion is compensated for via damping elements having a speed-dependent transmission behavior for arriving pulses and is thus independent of the selection of the material for the actuating element and valve housing. Thus a secure and precise method of operation of the fuel injection valve is assured.

Advantageous further developments of the fuel injection valve indicated in the main claim are possible by implementing the measures listed in the subclaims.

The simple design of the components from the point of view of manufacturing technology is advantageous. In particular the enclosing and prestressing of the actuator in an actuator housing are advantageous, since the thermal change in length of the actuator does not need to be compensated for by expensive material combinations, but is compensated for by a prestress spring. Thus the entire length of the actuator housing is unaffected by thermal changes in length. Thus by uncoupling the actuator and the valve housing, only a change in position of the actuator housing relative to the valve housing still needs to be compensated for.

The enclosing of a readjusting spring and damping element in a valve shell is also advantageous because of the resulting compact construction.

DETAILED DESCRIPTION

Figure 1:
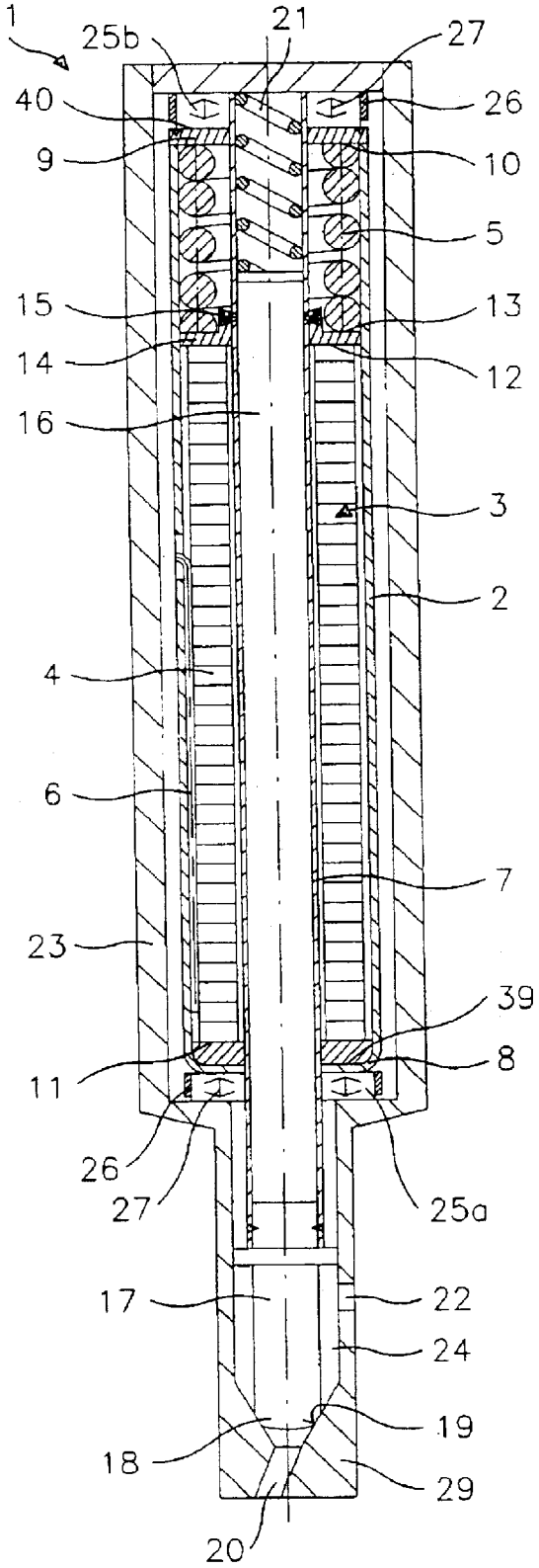
FIG. 1 shows an axial section through a first exemplary embodiment of a fuel injection valve of the present invention.

FIG. 1 shows a first exemplary embodiment of fuel injection valve 1 of the present invention in axial section. This is a fuel injection valve 1 that opens inwards.

Ring-shaped actuator 3 having central recess 7 made of disk-shaped piezoelectric or magnetostrictive elements 4 and prestress spring 5 are arranged in actuator housing 2. Actuator 3 is operated by an electronic control unit via a plug contact (not shown). For the sake of simplification, only a single connection wire 6 is shown in FIG. 1.

Actuator housing 2 is made of shell 8 and actuator housing cover 9. Actuator housing cover 9 rests against first end 10 of prestress spring 5. First face 11 of actuator 3 rests against an end of shell 8 on the spraying side, actuator 3 being surrounded radially by shell 8. Second face 12 of actuator 3 and second end 13 of prestress spring 5 are supported against intermediary center flange 14. Actuator 3 is prestressed by prestress spring 5 via shell 8.

Center flange 14 is preferably connected frictionally with actuating body 16 by welded seam 15. Actuating body 16 is arranged in central recess 7 of actuator 3 and is connected to valve needle 17 on which valve closing body 18 is formed. When valve closing body 18 is lifted away from valve seat surface 19, fuel is sprayed through spray aperture 20 formed in valve seat body 29. Actuating body 16 is supported at its end against readjusting spring 21. The fuel flows to the seat via fuel inlet 22 of valve housing 23 formed close to the seat and via space 24 between valve needle 17 and valve housing 23.

First ring-shaped damping element 25*a* is located at first end 39 of actuator housing 2, between shell 8 of actuator housing 2 and valve housing 23. Second ring-shaped damping element 25*b* is located at second end 40 of actuator housing 2, between actuator housing cover 9 of actuator housing 2 and valve housing 23. Damping elements 25*a*, 25*b* are made of a plastic, in particular of uncured silicone rubber, which exhibits an almost static behavior at a high deformation rate and is elastically or plastically deformable at a low deformation rate. Damping elements 25*a*, 25*b* have mechanical springs 27 whose damping behavior is superimposed on the damping behavior of the plastic. The plastic is advantageously enclosed in jacket 26. Damping elements 25*a*, 25*b* buffer actuator housing 2 against valve housing 23.

When an electrical activating voltage is applied to actuator 3 of fuel injection valve 1 of the present invention shown in FIG. 1, disk-shaped elements 4 of actuator 3 expand, causing center flange 14 to be moved against the direction of flow of the fuel. Prestress spring 5 is compressed further against the prestress already present. Valve closing body 18 lifts from valve seat surface 19 and fuel is sprayed through spray aperture 20 formed in valve seat body 29.

During the operation of fuel injection valve 1 of the present invention in an internal combustion engine, the high actuating frequency of actuator 3 causes damping elements 25*a*, 23*b* located between valve housing 23 and actuator housing 2 to behave like an incompressible solid, since when actuator 3 is set in motion it expands too fast for damping elements 25*a*, 25*b* to be compressed. The behavior of damping elements 25*a*, 25*b* is almost static, causing the pulse initiated by the electrical activating voltage to be transmitted to actuating body 16 and fuel injection valve 1 to open.

Fuel injection valve 1 experiences severe temperature fluctuations during operation. On the one hand, the entire fuel injection valve 1 is heated by contact with the combustion chamber of an internal combustion engine; on the other hand local temperature changes occur caused, e.g., by the power loss during deformation of piezoelectric actuator 3 or by electrical charge movement. This results in a thermal shortening in length of disk-shaped elements 4, since piezoelectric ceramics have negative temperature expansion coefficients, i.e., they contract when heated and expand when cooled.

Such a shortening of actuator 3 by heating is compensated for within actuator housing 2 by the expansion of prestressed spring 5. The shortening of actuator 3 leads to an elongation of prestress spring 5. Since center flange 14 is arrested at actuating body 16 via welded seam 15, a change in position of actuator housing 2 results from the change in length of actuator 3. This change in position of actuator housing 2 is compensated for by the buffering of actuator housing 2 within valve housing 23 by damping elements 25*a*, 25*b*, since, during the quasistatic static changes in position of actuator housing 2 relative to valve housing 23 due to temperature influences, actuator housing 2 moves so slowly that damping elements 25*a*, 25*b* are deformed elastically or plastically.

Figure 2:
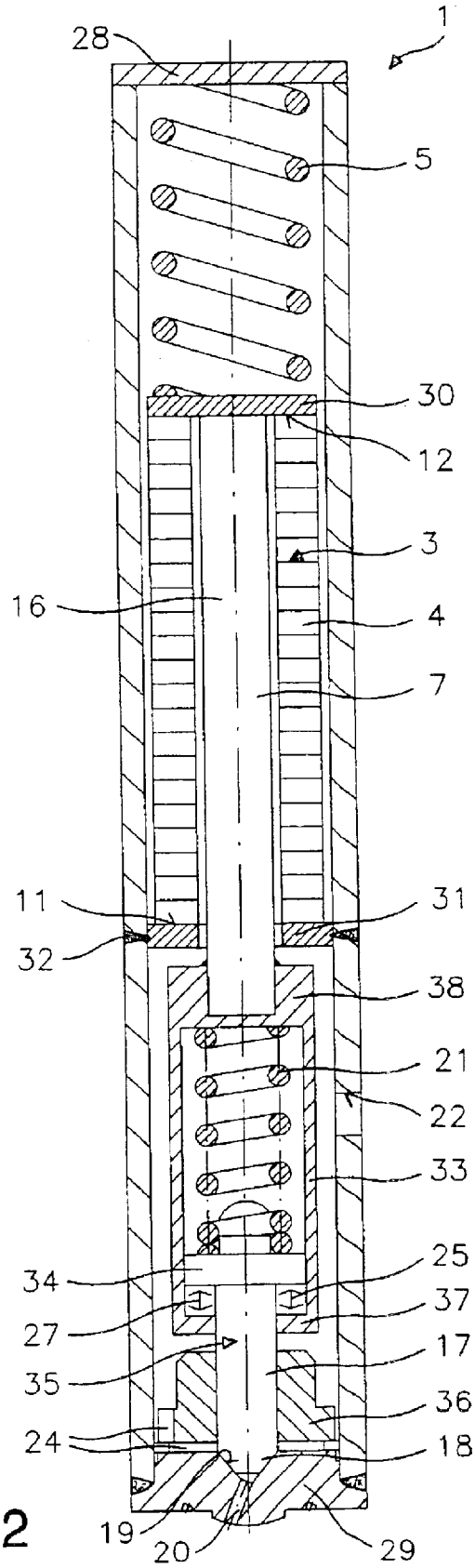
FIG. 2 shows an axial section through a second exemplary embodiment of a fuel injection valve of the present invention.

FIG. 2 shows in an axial section a second exemplary embodiment of fuel injection valve 1 of the present invention. Already described elements are provided with corresponding reference numbers, so that a repeated description is unnecessary.

In this exemplary embodiment, actuator 3 rests at its second face 12 against actuator housing cover 30, against which prestress spring 5 is supported and is clamped between actuator housing cover 30 and valve housing cover 28. Actuator 3 is supported at its first face 11 against flange 31, which is operably connected to valve housing 23 by welded seam 32. Actuating body 16 is mounted on actuator housing cover 30 and is conducted through central recess 7 of actuator 3.

Actuating body 16 projects at one end into valve shell 33. In valve shell 33 readjusting spring 21 and damping element 25 are enclosed so that readjusting spring 21 and damping element 25 are supported against intermediary valve needle flange 34. Readjusting spring 21 is clamped between cover plate 38 of valve shell 33 and valve needle flange 34. Valve needle flange 34 and valve needle 17, which projects through recess 35 in base plate 37 of valve shell 33, are formed in one piece. Valve needle 17 is conducted through valve needle guide 36. Valve closing body 18, which forms a seat with valve seat surface 19, forms the termination of valve needle 17. The fuel is fed via a lateral fuel inlet 22 and flows to the seat via space 24 between valve needle 17 and valve housing 23. At least one spray aperture 20 is formed in valve seat body 29.

When an electrical activating voltage is applied to actuator 3 of fuel injection valve 1 of the present invention, piezoelectric elements 4 of actuator 3 expand. Since actuator 3 at its first face 11 rests against flange 31, which is connected permanently to valve housing 23 via welded seam 32, it expands in the lift direction and entrains actuating body 16 in the lift direction. Due to the hard transmission behavior of damping element 25, actuating body 16, operably connected to valve shell 33, entrains valve needle 17 via valve needle flange 34 and thus opens fuel injection valve 1.

The hard transmission behavior of damping element 25 is caused by the high switching speed of actuator 3. When actuator 3 is set in motion, actuating body 16 moves so quickly that damping element 25 behaves like an incompressible solid and transmits the pulse to valve needle flange 34 and valve needle 17. However, fuel injection valve 1 is also subject to a heat expansion. During this slow change in length of actuator 3, damping element 25 exhibits a soft transmission behavior. When actuating body 16 is displaced by a quasi-static thermal that change in length of actuator 3, the movement is compensated for by damping element 25 in that damping element 25 is compressed and valve closing body 18 is pressed against valve seat surface 19 by prestress spring 5 via valve needle flange 34.

The present invention is not limited to the exemplary embodiments shown; it can also be implemented with a plurality of other constructions of fuel injection valves 1.

What is claimed is:

1. A fuel injection valve, comprising:

one of a piezoelectric actuator and a magnetostrictive actuator;

a valve needle;

a valve seat surface;

a valve closing body that can be activated by the one of the piezoelectric actuator and the magnetostrictive actuator via the valve needle and that interacts with the valve seat surface to produce a sealing seat; and at least one damping element including a solid that exhibits an almost static behavior at a high deformation rate and is one of elastically deformable and plastically deformable at a low deformation rate.

2. The fuel injection valve according to claim 1, wherein:

the fuel injection valve corresponds to an injection valve for a fuel injection system of an internal combustion engine.

3. The fuel injection valve according to claim 1, wherein:

the solid of the at least one damping element includes a plastic.

4. The fuel injection valve according to claim 3, wherein:

the plastic includes an uncured silicone rubber.

5. The fuel injection valve according to claim 3, wherein:

the at least one damping element includes a mechanical spring exhibiting a damping behavior that is superimposed on a damping behavior of the plastic.

6. A fuel injection valve, comprising:

one of a piezoelectric actuator and a magnetostrictive actuator;

a valve needle;

a valve seat surface;

a valve closing body that can be activated by the one of the Piezoelectric actuator and the magnetostrictive actuator via the valve needle and that interacts with the valve seat surface to produce a sealing seat;

at least one damping element including a solid that exhibits an almost static behavior at a high deformation rate and is one of elastically deformable and plastically deformable at a low deformation rate;

a shell;

an actuator housing including an actuator housing cover;

a prestress spring; and a center flange, wherein:

a first face of the one of the piezoelectric actuator and the magnetostrictive actuator is supported against the shell, the prestress spring rests with a first end against the actuator housing cover that terminates the shell to produce the actuator housing, and a second face of the one of the piezoelectric actuator and the magnetostrictive actuator and a second end of the prestress spring are supported against the center flange.

7. The fuel injection valve according to claim 6, further comprising:

a valve housing, wherein:

the at least one damping element includes a first ring-shaped damping element and a second ring-shaped damping element, and the actuator housing together with the one of the piezoelectric actuator and the magnetostrictive actuator contained therein and the prestress spring has a constant length and is supported against the valve housing with another first end via the first ring-shaped damping element and with another second end via the second ring-shaped damping element.

8. The fuel injection valve according to claim 6, wherein:

the valve needle is connected to the center flange via a welded seam.

9. A fuel injection valve, comprising:

one of a Piezoelectric actuator and a magnetostrictive actuator;

a valve needle;

a valve seat surface;

a valve closing body that can be activated by the one of the piezoelectric actuator and the magnetostrictive actuator via the valve needle and that interacts with the valve seat surface to produce a sealing seat;

at least one damping element including a solid that exhibits an almost static behavior at a high deformation rate and is one of elastically deformable and plastically deformable at a low deformation rate;

a flange; and a cover plate, wherein:

the one of the piezoelectric actuator and the magnetostrictive actuator is supported with a first face thereof against the flange and with second face thereof against the cover plate.

10. The fuel injection valve according to claim 9, further comprising:

a valve housing, wherein:

the flange is connected to the valve housing via a welded seam.

11. The fuel injection valve according to claim 9, further comprising:

a valve shell; and an actuating body supported at one end against the cover plate and being operably connected to the valve needle via the valve shell.

12. The fuel injection valve according to claim 11, further comprising:

a readjusting spring; and a flange of the valve needle, wherein:

the valve shell includes a cover plate and a base plate, the readjusting spring and the flange of the valve needle are enclosed in the valve shell, the at least one damping element is arranged between the flange of the valve needle and the base plate of the valve shell, and the readjusting spring is clamped between the flange of the valve needle and the cover plate of the valve shell.

13. The fuel injection valve according to claim 12, wherein:

a recess, through which the valve needle extends, is located in the base plate of the valve shell.

14. A fuel injection valve, comprising:

one of a Piezoelectric actuator and a magnetostrictive actuator;

a valve needle;

a valve seat surface;

a valve closing body that can be activated by the one of the piezoelectric actuator and the magnetostrictive actuator via the valve needle and that interacts with the valve seat surface to produce a sealing seat;

at least one damping element including a solid that exhibits an almost static behavior at a high deformation rate and is one of elastically deformable and plastically deformable at a low deformation rate;

an actuating body that acts on the valve needle, wherein:

the one of the piezoelectric actuator and the magnetostrictive actuator is ring-shaped and includes a central recess through which extends the actuating body.

15. The fuel injection valve according to claim 1, wherein the at least one damping element has a ring shape and compensates for thermal expansion of the at least one of the piezoelectric actuator and the magnetostrictive actuator.

16. The fuel injection valve according to claim 1, wherein the at least one damping elements is disk shaped and includes a mechanical spring.

* * * * *